United States Patent [19]

Thioulouse et al.

[11] Patent Number: 4,877,995

[45] Date of Patent: Oct. 31, 1989

[54] ELECTROLUMINESCENT DISPLAY DEVICE USING HYDROGENATED AND CARBONATED AMORPHOUS SILICON

[75] Inventors: Pascal Thioulouse, Paris; Ionel Solomon, Boulogne, both of France

[73] Assignee: Etat Francais Represente par le Ministre des PTT, Paris, France

[21] Appl. No.: 110,116

[22] Filed: Oct. 19, 1987

[30] Foreign Application Priority Data

Oct. 23, 1986 [FR] France ..... 86 14715

[51] Int. Cl.[4] ..... G09F 3/30

[52] U.S. Cl. ..... 313/507; 313/385; 315/169.3

[58] Field of Search ..... 313/498, 506, 507, 384, 313/385; 315/169.3; 427/66, 74

[56] References Cited

U.S. PATENT DOCUMENTS 3,560,784 2/1971 Steele ..... 313/509 X 4,675,265 6/1987 Katoma et al. ..... 430/57 X 4,695,717 9/1987 Hirai et al. ..... 313/386 X

FOREIGN PATENT DOCUMENTS 8603871 7/1986 France .

OTHER PUBLICATIONS

Article Entitled "Influence of Carbon Incorporation in Amorphous Hydrogenated Silicon" in the Philosophical Magazine B, 1985, vol. 51, No. 6, pp. 581-589.

*Primary Examiner*—Donald J. Yusko
*Assistant Examiner*—Michael Horabik
*Attorney, Agent, or Firm*—Pearne, Gordon, McCoy & Granger

[57] ABSTRACT

An electroluminescent display device uses a photoconductive material which is of hydrogenrated and carbonated amorphous silicon of formula a-$Si_xC_{1-x}$; with $1-x$ preferably between 0.05 and 0.50 and which has application to display functions.

6 Claims, 1 Drawing Sheet

Figure 1:
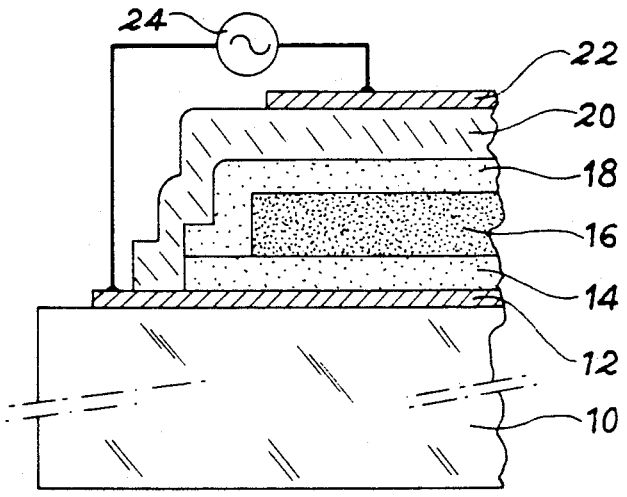

ELECTROLUMINESCENT DISPLAY DEVICE USING HYDROGENATED AND CARBONATED AMORPHOUS SILICON

DESCRIPTION

The present invention relates to an electroluminescent display device using hydrogenated and carbonated amorphous silicon.

Although the device according to the invention does not necessarily have a memory effect, as will be apparent hereinafter, this is in fact the property which is most sought in practice and therefore a brief description will be given of what is involved. A display device is said to have a memory effect if its electrooptical characteristic (luminance-voltage curve) has a hysteresis. Thus, for the same voltage within the hysteresis loop, the device could have two stable states, namely extinguished (off) or illuminated (on). Plasma display screens with a.c. excitation have such a bistability characteristic, which is now widely used.

A memory effect display is very advantageous, so that for displaying a fixed image, it is merely necessary to simultaneously and continuously apply a so-called maintenance voltage to the entire screen. This voltage can e.g. be a square-wave or sinusoidal signal. However, in particular, the form and frequency of said maintenance signal can be chosen independently of the complexity of the screen, particularly the number of display point lines. Thus, in principle, there is no limit to the complexity of a memory effect display screen. Thus, plasma display screens with an a.c. excitation are commercially available with 1200×1200 picture elements.

Moreover, the technology of capacitive coupling, thin film, electroluminescent display or ACTFEL has now reached maturity on an industrial level. This technology can be given a so-called inherent memory effect, but this leads to a significant deterioration to the electrooptical performance levels. A more attractive method consists of connecting a photoconductive structure (PC) in series with an electroluminescent structure (EL) and then optically coupling said two structures.

Such a device is e.g. described in the article A. H. Kitai and G. J. Wolga entitled "Hysteretic Thin Film EL Devices Utilizing Optical Coupling of EL Output to a Series Photoconductor" published SID Conference Reports 84, pp. 255/6.

Thus, it is possible to produce an extrinsic memory effect, which is called the PC-EL memory effect, whose principle is as follows. When the device is in the off state, the photoconductor is not very conductive and retains a large part of the voltage V applied to the assembly. On increasing V to a value V-on such that the voltage at the terminals of the electroluminescent layer exceeds the electroluminescence threshold, the PC-EL device switches into the on state. The photoconductor is then illuminated by the electroluminescent structure and passes into the conductive state. The voltage at its terminals drops and this leads to an increase in the voltage available for the electroluminescent structure. In order to extinguish a PC-EL device, it is merely necessary to reduce the total voltage V to a value V-off below V-on, which thus gives a luminance-voltage characteristic having a hysteresis.

A new PC-EL structure was described recently in FR-A-2 574 972 and in the article by the inventors entitled "Monolithic AC-EL Photoconductor Thin Film Structure with Extrinsic Memory by Optical Coupling" and published in the reports of the International Display Research Conference, 1985, pp. 177–181.

This structure is illustrated in FIG. 1. It comprises a glass substrate 10 on which is deposited an electrode 12, e.g. of ITO (indium and tin oxide), a first dielectric layer 14, an electroluminescent layer 16, e.g. of ZnS:Mn, a second dielectric layer 18, a photoconductive layer 20 constituted by a stack of layers $n^+$-n-$n^+$ of hydrogenated amorphous silicon a-Si:H and finally an e.g. aluminium electrode 22. Electrodes 12 and 22 are connected to a voltage supply 24. In this construction, layers PC and EL are thin films, whose thickness is approximately 1 micron. It is pointed out that the $n^+$ layers, which are highly n doped and have a very limited thickness (typically 20 nm) have the function of permitting a quasi-ohmic electronic injection into the so-called intrinsic layer n. Provided that this quasi-ohmic injection is obtained, it is the electrical and photoconductive characteristics of the intrinsic layer which mainly determine the behaviour of the stack $n^+$-n-$n^+$, here called the "photoconductive layer" and the memory characteristics of the PC-EL device.

It is easy to realise such a structure, because it requires no optical screen or supplementary etching stages. Moreover, the current-voltage behaviour of the thin film photoconductor in the dark is highly non-linear and reproducible. The resulting beneficial consequences are that it is always easy to illuminate the device, the hysteresis is only slightly dependent on the exciting frequency and the reproducibility of the hysteresis margin between individual production runs is guaranteed.

As a result of the initial encouraging results, the inventors have continued their research in order to become better acquainted with the phenomena involved in such structures and in order to better define the constraints imposed by the PC-EL structure. They have been able to clearly define the conditions which must be satisfied in order to obtain a high performance device:

(1) It is preferable for the photoconductive layer to be as thin as possible (thickness below 2 μm), so as to limit the disturbances which it may cause on the electroluminescent structure on which it is deposited. They e.g. consist of mechanical stresses, which can lead to a detachment of the layers or to a poor healing of electrical breakdowns occurring in the electroluminescent structure.

(2) As the photoconductive layer must in the off state withstand a voltage of 30 to 50 V applied perpendicularly to the plane of the layers, combined with the constraint referred to hereinbefore of a limited thickness, makes it necessary that the photoconductive layer is able to withstand electric fields which can reach $10^6$ V/cm. Thus, the material must have a high resistivity.

(3) The photoconductivity should be fixed at a sufficiently low value to substantially cancel out any influence of ambient light on the operation of the PC-EL device, whilst drawing the maximum benefit from the considerable variation between the ambient illumination level (typically below 1000 lux) and that produced by the electroluminescent layer (typically approximately 20000 lux).

(4) The mechanism governing the conduction in a-Si:H also cause certain problems. Theoretical studies have been published on this subject and it would appear that the conduction mechanism in structures $n^+$-n-$n^+$ in a-Si:H is of the space charge limited conduction or SCLC type. This means that the conduction in the layer n is clearly dependent on the resistivity R of the layer under ohmic conditions, but is also dependent and to a more significant extent on the space charge distributed throughout the depth of the layer. In an article by I. Solomon et al. entitled "Space-Charge-Limited Conduction for the determination of the midgap density of states in amorphous silicon: Theory and Experiment" published in "The American Physical Society", vol. 30, No. 6, pp. 3422–3429, the authors have defined a precise theoretical model for the current-voltage (I-V) behaviour of a $n^+$-n-$n^+$ structure in quasi-equilibrium conditions (continuous applied voltage). They have also determined the influence of the resistivity R and the density of state at the quasi-Fermi level (DOS) of layer n n the I-V curve. The following formula makes it possible to approximately take account of this dependence:

$$I = \frac{1}{RL} V \exp(V/Vo) \text{ with } Vo = ag(E_F)$$

in which L is the thickness of layer n, $g(E_F)$ the DOS at the quasi-Fermi level and a constant.

From these theoretical results (which, it must be stressed, do not relate to the application to PC-EL devices), the inventors have deduced that for a given conduction current (case of the operation of the PC in a PC-EL structure in the off state), the voltage at the terminals of the $n^+$-n-$n^+$ structure is substantially proportional to the DOS on the one hand and to the logarithm of the resistivity on the other.

(5) The inventors have also considered the question of the sensitivity spectrum of a photoconductive material. This spectrum is directly linked with the forbidden bandwidth of the material used and its intensity is dependent on the characteristics of the recombination centres of the electron-hole pairs produced by photoexcitation (energy depth, capture cross-section, detrapping time, etc.). For an optimum PC-EL memory effect, it would be desirable to adapt the spectrum of the photoconductor to that of the electroluminescent structure, so as to improve the optical coupling between the EL and PC layers. However, in a system using a-Si:H, there is no way in which this adaptation can be carried out.

In summarizing, the inventors on the basis of their own research and certain theoretical studies performed on a-Si:H, have been able to investigate certain problems encountered in connection with electroluminescent devices with a photoconductor. The choice of the photoconductive material must make it possible to control at appropriate values the resistivity, the density of state at the quasi-Fermi level, the photoconductivity and the spectrum of the photoconductive layer.

However, conventional materials such as CdS or CdSe or a-Si:H are not able to reproducibly satisfy all these conditions, because they are not intrinsically sufficiently resistive and are in general too photoconductive. Thus, in order to produce the PC-EL structure described in the last reference, the inventors had to deposit the a-Si:H layer on a substrate kept at a relatively high temperature between 350° and 400° C. However, then the reproducibility of characteristics such as the density of state and resistivity caused considerable problems, due to the high dependence thereof on the deposition temperature in this range.

However, the inventors have now discovered a material making it possible to fulfill all or at least a large number of these conditions and which is constituted by hydrogenated and carbonated amorphous silicon whose formula is a-$Si_xC_{1-x}$:H.

More specifically, the present invention relates to an electroluminescent display device having on an insulating layer an electrolumniscent layer and a photoconductive layer, said layers being stacked one on top of the other, said two layers being inserted between two electrode systems connected to a voltage supply permitting the excitation of certain zones of the electroluminescent layer, characterized in that the photoconductive layer is of hydrogenated and carbonated amorphous silicon a-$Si_xC_{1-x}$:H.

More specifically, the photoconductive layer will be constituted by an intrinsic layer n of hydrogenated and carbonated amorphous silicon a-$Si_xC_{1-x}$:H, optionally inserted between two $n^+$ layers with quasi-ohmic injection, also of hydrogenated and carbonated amorphous silicon a-$Si_yC_{1-y}$:H.

Figure 2:
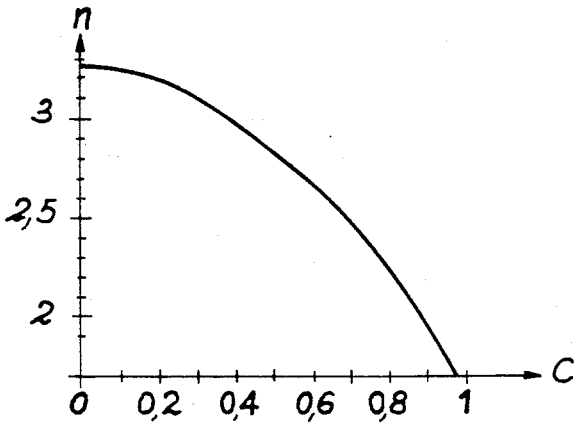

The invention will be better understood from reading the following description with reference to the attached drawings, wherein show:

FIG. 1, already described, a section through an electroluminescent display device having a photoconductive layer. FIG. 2 a graph showing the variations in the refractive index of the photoconductive layer as a function of the methane concentration in the gaseous mixture used for depositing a-$Si_xC_{1-x}$:H.

Figure 3:
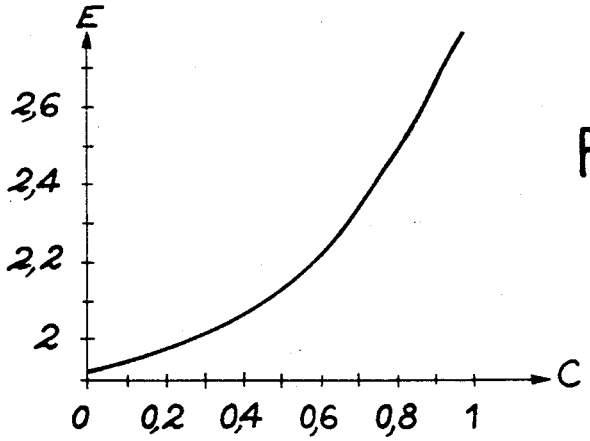

FIG. 3 the variation of the spectrum of said layer as a function of said same concentration.

The photoconductivity drops at short wavelengths (high energy levels), as a result of the absorption of the radiation in the material. A characteristic of the photoconductivity spectrum of the a-$Si_xC_{1-x}$:H is the energy $E_{04}$ (in eV) at which the absorption coefficient $\alpha$ is $10^4$ $cm^{-1}$ and this energy is shown in FIG. 3.

According to the invention, 1−x is preferably between 0.05 and 0.50, or in other words the carbon concentration [C]/[C]+[Si] is between 5 and 50%.

The more precise choice of 1−x within this range is dependent on the sought objectives and envisaged applications. It is possible to define four different ranges between 0.05 and 0.50:

1. If 1−x is increased from 0 to 0.35, the DOS and R increase with an optimum around 0.10.

2. If 1−x is increased from 0.10 to 0.35, the photoconductivity decreases and an optimum can be defined as a function of the previous point.

3. If 1−x is increased from 0 to 0.50, the sensitivity spectrum of the photoconductivity is displaced and $E_{04}$ passes from 1.9 to 2.7 eV.

4. If 1−x is increased from 0 to 0.40, the refractive index is reduced from 3.6 to approximately 2.0.

Thus, the invention gives a supplementary degree of freedom (the carbon concentration) for adjusting certain characteristics, which was not possible with a-Si:H.

For example, taking $1-x=0.10$, the inventors reproducibly obtained a conductivity in the dark in the range $10^{-11}$ to $10^{-10}\Omega^{-1}cm^{-1}$ which corresponds to a resistivity between $10^{11}$ to $10^{10}\Omega$cm. and a DOS in the range 30 to $40.10^{16}$ $eV^{-1}cm^{-3}$. These characteristics made it possible to obtain hysteresis margins exceeeding 25 V at an exciting frequency of 1 kHz.

With regards to the adaptation of the photoconductor spectrum it is known that the transmission wavelengths used for polychromatic display are approximately 450 nm for blue and approximately 640 nm for red. It is possible to obtain an adaptation to such spectra by taking $1-x$ respectively equal to 0.50 for the blue and 0.05 for the red.

Apart from the memory effect which it gives in a PC-EL device, the photoconductive layer can give an electroluminescent structure an excellent display contrast as a result of its accompanying "black layer" effect. Thus, the photoconductive layer masks the rear aluminium electrodes, absorbs the ambient light and prevents the reflection thereof on the electrodes. One application of the invention is thus the production of electroluminescent display devices with a high contrast level and without memory effect.

The principle of using an absorbent layer is naturally known and is e.g. described in the aforementioned publication of the inventors, as well as in U.S. Pat. No. 3,560,784. However, in these earlier documents the "black layer" is sometimes of a-Si:H and sometimes a dielectric, i.e. materials having a given composition and therefore given properties. It is not therefore possible to freely act on the optical properties of these materials. According to the invention, it is possible to fix the refractive index within a wide range (2.0 to 3.6) by acting on $1-x$ and to optically adapt the black layer to the other layers, e.g. to the dielectric layer adjacent thereto and which can be of $Ta_2O_5$ with an index of 2.1 or to the electroluminescent layer, which can be of ZnS of index 2.35. Thus, there is a minimisation of the reflections of the ambient light by the underlying photoconductive layer diopter (insulant or electroluminescent layer).

With regards to the $n^+$ layers, the incorporation of C has certain specific advantages which will be described hereinafter.

The doping of a a-Si:H layer with phosphorus (P) makes it possible to significantly increase the density of the free carriers up to $10^{18}$–$10^{19}$ $cm^{-3}$. It is this high free carrier density which ensures a quasi-ohmic electronic injection into the intrinsic layer. However, the ohmic conductivity of such $n^+$ layers is so high ($10^{-2}$ to $10^{-3}\Omega^{-1}.cm^{-1}$) that it causes parasitic lateral conduction phenomena in matrix PC-EL screens. The incorporation of C into the $n^+$ layer makes it possible to significantly reduce the conductivity thereof without significantly modifying the free carrier density. Thus, for example, with a mixture of 50% $[SiH_4]$—50% $[CH_4]$ (see content therein in layer of $\simeq$0.14), the ohmic conductivity of the P-doped $n^+$ layer is typically reduced to $10^{-5}$—$10^{-6}\Omega^{-1}.cm^{-1}$ and the parasitic electrical effects in the matrix PC-EL screens disappear.

In summarizing the incorporation of carbon into the a-Si:H has positive effects both for the intrinsic n layer and for the $n^+$ layers possibly introduced into the photoconductive structure.

With regards to the conditions to be used for realizing the invention, reference can be made to two articles, namely by M. P. Schmidt et al entitled "Physics of Low Density-Off-States a-$Si_{1-x}C_x$ films" published in Journal of Non-Crystalline Solids 77 and 78, pp. 849–852 and the second by M. P. Schmidt et al entitled "Influence of Carbon incorporation in amorphous hydrogenated silicon" published in "Philosophical Magazine" B, 1985, vol. 51, no. 6, pp. 581–589.

In the technique described in these documents, the hydrogenated and carbonated amorphous silicon layers are deposited by glow discharge from a mixture of silane ($SiH_4$) and methane ($CH_4$). When the $CH_4$ content of the mixture varies in a range between 0 and 60%, the carbon $1-x$ content in the deposited layer varies from 0 to 0.2. By varying the $CH_4$ content of the gaseous mixture, it is possible to reproducibly obtain conductivity values in the black and DOS values extending over wide ranges such as $10^{-6}$–$10^{-13}$ $(\Omega cm)^{-1}$ for the conductivity and $2.10^{15}$–$10^{18}$ $cm^{-3}eV^{-1}$ for the DOS. It is as a result of this property that the inventors have been able, by choosing a $CH_4$ content of 35%, to obtain a value of approximately 0.10 for $1-x$ and reproducibly obtain a conductivity of the photoconductive layer of $10^{-10}\Omega^{-1}cm^{-1}$ and a DOS of approximately $4.10^{17}eV^{-1}cm^{-3}$. In recent works, the study range of the $CH_4$ concentration in the gaseous mixture of $SiH_4$—$CH_4$ has extended to 95% and it has been possible to obtain by this method values of $1-x$ exceeding 0.5, i.e. exceeding the requirements of the present invention.

FIGS. 2 and 3 give a better idea of the experimental conditions for obtaining certain performance levels. The abscissa axis corresponds to the methane concentration C to be used in the methanesilane gaseous mixture, or in other words $C=[CH_4]/[CH_4]+[SiH_4]$.

The ordinate axis corresponds to the refractive index n in FIG. 2 and to the energy E04 of the absorption band of the photoconductor expressed in electron volts in FIG. 3. These curves correspond to a substrate temperature between 250° and 290° C.

Naturally, the adjustment of $1-x$ for optimizing the DOS, resistivity, photoconductivity, spectrum, index, etc. in no way excludes the regulating of the deposition conditions (substrate temperature, plasma power level, etc.). This regulation makes it possible to further improve the effects of the presence of carbon, or to compensate said action. This is e.g. the case when $1-x$ is chosen for adjusting the index and/or photoconductivity spectrum and it is wished to also correct the DOS resisitivity and photoconductivity resulting from this choice. Thus, the action on $1-x$ can be advantageously combined with conventional adjustments concerning the operating conditions in order to simultaneously satisfy all the aforementioned conditions.

The $n^+$ layers of a-$Si_{1-y}C_y$:H will e.g. be obtained by adding to the mixture of $[SiH_4]$—$[CH_4]$ an adequate concentration of $[PH_3]$ (typically 0.5%).

The invention is applicable to any electroluminescent structure in thin film or powder-based form and with a.c. or d.c. excitation, although the example described relates to thin film, a.c. excitation electroluminescence.

We claim:

1. Electroluminescent display device comprising on an insulating support (10) an electroluminescent layer (16) and a photoconductive layer (20), said layers being stacked on one another, the two layers being inserted between two systems of electrodes (12,22) connected to a voltage supply source (24) permitting the excitation of certain zones of the electroluminescent layer, said device being characterized in that the photoconductive layer is of hydrogenated and carbonated amorphous silicon a-$Si_xC_{1-x}$:H, wherein $1-x$ is between 0.05 and 0.50.

2. Display device according to claim 1, characterized in that $1-x$ is between 0.10 and 0.35.

3. Display device according to claim 2, characterized in that the thickness of the photoconductive layer is below 2 microns and that the device has a PC-EL memory effect.

4. Display device according to claim 1, characterized in that $1-x$ chosen in one of the following ranges 0.05 to 0.15, 0.10 to 0.35 and 0.25 to 0.50, the sensitivity spectrum of the photoconductive layer then being adapted to the light spectrum emitted by the electroluminescent layer.

5. Display device according to claim 1, characterized in that $1-x$ is between 0.20 to 0.50.

6. Display device according to claim 5, characterized in that $1-x$ is also chosen in such a way that the resistivity of the photoconductive layer exceeds $10^{10}\Omega.cm$.

* * * * *

UNITED STATES PATENT AND TRADEMARK OFFICE

CERTIFICATE OF CORRECTION

PATENT NO. : 4,877,995

DATED : October 31, 1989

INVENTOR(S) : Pascal Thioulouse

It is certified that error appears in the above-identified patent and that said Letters Patent is hereby corrected as shown below:

In the Abstract, line 2, delete "hydrogenrated" and insert --hydrogenated--.

line 3, the formula "a-$Si_xC_{1-x}$;" should read as --a-$Si_xC_{1-x}$:H--.

Under References Cited (U.S.), second reference, delete "Katoma" and insert --Kazama--.

Column 1, line 43, after "Article" insert --by--.

Column 1, line 46, after "published" insert --in--.

Column 3, line 15, delete "n" (second occurrence) and insert --on--.

Column 4, line 25, FIG. 2 should begin a new paragraph.

Column 4, line 60, delete "$10^{11}$ to $10^{10}$" and insert --$10^{-11}$ to $10^{-10}$--.

Signed and Sealed this

Twenty-fifth Day of December, 1990

*Attest:*

*Attesting Officer*

HARRY F. MANBECK, JR.

*Commissioner of Patents and Trademarks*